United States Patent [19]

Nishida et al.

[11] 4,393,850

[45] Jul. 19, 1983

[54] IGNITION SYSTEM FOR INTERNAL COMBUSTION ENGINES

[75] Inventors: Minoru Nishida; Tadashi Hattori; Akira Tanaka, all of Okazaki, Japan

[73] Assignee: Nippon Soken, Inc., Nishio, Japan

[21] Appl. No.: 279,516

[22] Filed: Jul. 1, 1981

[30] Foreign Application Priority Data

Jul. 10, 1980 [JP] Japan ..... 55/95887

[51] Int. Cl.[3] ..... F02P 15/02; F02P 15/10; F02P 15/00

[52] U.S. Cl. ..... 123/536; 123/620

[58] Field of Search ..... 123/620, 628, 640, 598, 123/596, 536; 315/209 T, 176, 209 CD

[56] References Cited

U.S. PATENT DOCUMENTS

| | | | |
|---|---|---|---|
| 3,565,048 | 2/1971 | Morpetit | 123/620 |
| 3,837,326 | 9/1974 | Kamiji | 123/620 |
| 4,245,609 | 1/1981 | Gerry | 123/620 |
| 4,269,160 | 5/1981 | Irvin, Jr. | 123/620 |
| 4,287,862 | 1/1983 | Noguchi et al. | 123/310 |
| 4,291,661 | 9/1981 | Gerry | 123/620 |
| 4,301,782 | 11/1981 | Wainwright | 123/620 |

FOREIGN PATENT DOCUMENTS

| | | | |
|---|---|---|---|
| 2733400 | 1/1978 | Fed. Rep. of Germany | 123/536 |

*Primary Examiner*—Raymond A. Nelli

*Attorney, Agent, or Firm*—Cushman, Darby & Cushman

[57] ABSTRACT

An ignition system for an internal combustion engine includes an ignition coil system for applying a secondary generated voltage of an ignition coil and a DC high voltage to each of spark plugs and an ignition control circuit for controlling the ignition coil system. The ignition control circuit includes an ignition coil control circuit for energizing and deenergizing the ignition coil and a DC high voltage generating circuit for generating a DC high voltage. The DC high voltage generating circuit generates the DC high voltage from before the secondary generated voltage of the ignition coil causing capacitive discharge at a spark plug to a predetermined time or crank angle after the start of the discharge.

9 Claims, 12 Drawing Figures

IGNITION SYSTEM FOR INTERNAL COMBUSTION ENGINES

BACKGROUND OF THE INVENTION

1. Field of the Invention

The present invention relates to an ignition system for internal combustion engines which is designed so that a DC high voltage is applied to the gap of a spark plug from a time before the start of capacitive discharge at the spark plug to a predetermined time or to a predetermined crank angle after the start of the discharge, whereby controlling sustained discharge and thereby improving the ignition performance.

2. Description of the Prior Art

Recently, from the standpoint of saving of resources, the most important problem for the automobile has been to improve the fuel consumption. To accomplish this objective, there has been tendency toward increasing the compression ratio for improving the combustion efficiency and rendering the air-fuel ratio of mixtures leaner for improving the fuel comsumption. In this case, what are important with the ignition system are the dielectric breakdown voltage at the plug gap and the ignition performance. FIG. 1 shows the dielectric breakdown voltages at the plug gap with different compression ratios (fuel is propane; density is 2.5%; ignition timing is set at top dead center). The difference between the breakdown voltage at the compression ratio of 8.4 and that the compression ratio of 12.9 is about 6 KV. Also, increasing the plug gap to improve the ignition performance tends to increase the breakdown voltage, and rendering leaner the air-fuel ratio of mixtures also results in an increase in the breakdown voltage. Since the breakdown voltage increases in this way, when any of the presently available ignition systems is used, even if a high voltage is produced in the secondary winding of the ignition coil and the high voltage reaches the dielectric breakdown voltage causing a capacitive discharge, the dielectric breakdown voltage is so high as shown in FIG. 2 such that there are instances where the energy is consumed during the interval between the occurrence of the high voltage and the occurrence of capacitive discharge and the energy for sustained discharge is reduced, thus failing to cause a sustained discharge and causing an open type waveform. In this case, since capacitive energy is increased, there will be no problem if the increased capacitive energy is sufficient to ignite the mixture. However, usually the time required for the flame core in the combustion chamber to effect the flame propagation by its own ability is about 1 ms so that if the energy possessed by the flame core is small, the flame core will be extinguished during this time interval due to the cooling effect of the electrodes and the mixture. As a result, it is necessary to supply energy to the flame core until it grows up. In case of the waveform shown in FIG. 2, only the capacitive energy is supplied and the following sustained discharge energy is not supplied, making it difficult to effect the ignition. As a result, in cold starting, racing or the like where the dielectric breakdown voltage increases, misfiring tends to be caused, thus causing deterioration of the feeling, engine stalling, etc. It is known as a countermeasure, to improve the performance of an ignition coil. For instance, it is to increase the size and the number of turns of an ignition coil so a to increase the secondary high voltage of the ignition coil, or to increase the magnitude of the current at the time of deenergizing the primary winding so as increase the energy, or making the ignition coil into a closed magnetic circuit coil so as to decrease the energy loss, etc. However, these methods are subjected to limitations in view points of coil conversion efficiency, heat generation, etc., and further these methods are effective only in increasing the energy, but result in increase in wear of the spark plugs. Other methods are known in which, as disclosed in Japanese Patent Publications No. 51-39326, No. 51-106837 and No. 53-131338, a capacitor is preliminarily charged with a high voltage so that the discharge caused at the spark plug by the voltage produced in the ignition coil is used as a trigger to discharge the charged energy of the capacitor to the spark plug. In this case, since the energy discharged by the capacitor is fixed and the energy is superposed on the energy in the secondary winding of the ignition coil, the total energy supplied to the mixture is increased and the ignition performance is improved. However, there is a disadvantage that since the capacitance energy varies in dependence on the conditions at the plug discharge gap (the density of mixture, pressure, etc.), the sustained discharge time also varies and a situation arises in which even if the flame core produced by the discharge grows up in the combustion chamber and starts the flame propagation by its own ability, the discharge is not completed as yet and wear of the spark plug electrodes is increased. Thus, the energy to be supplied must be limited to the minimum requirement.

SUMMARY OF THE INVENTION

It is the object of the present invention to provide an improved ignition system for internal combustion engines, in which an ignition coil is so designed that the total energy is small but the secondary high voltage is increased, and a DC high voltage is applied to the spark plug gap from a time before the start of capacitive discharge to a predetermined time or to a predetermined crank angle after the start of capacitive discharge, whereby the dielectric breakdown of the plug gap is effected by the high voltage produced in the ignition coil and the following sustained discharge is effected by the DC high voltage, thus effectively supplying the energy to the mixture and thereby improving the ignition preformance and preventing any excessive discharge to reduce wear of spark plug electrodes.

BRIEF DESCRIPTION OF THE DRAWINGS

FIG. 3 shows a plurality of waveforms for explaining the operation of the system shown in FIG. 7.

DESCRIPTION OF THE PREFERRED EMBODIMENTS

Figure 1:
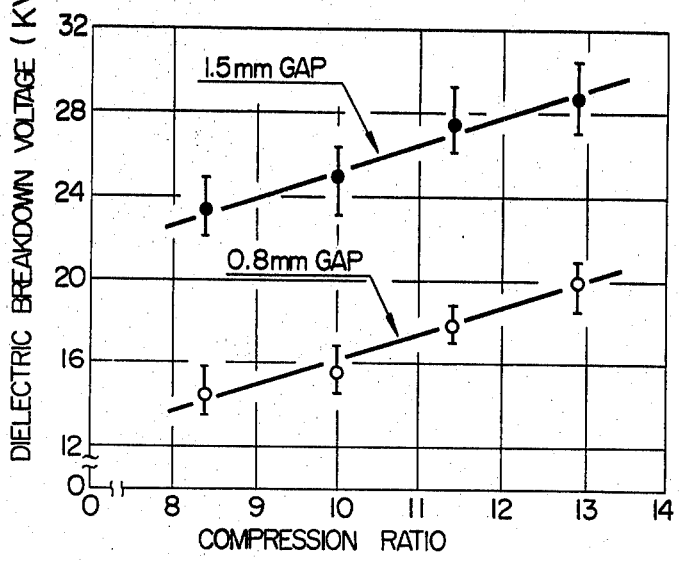
FIG. 1 is an ignition dielectric breakdown voltage characteristic diagram of an internal combustion engine.
Figure 2:
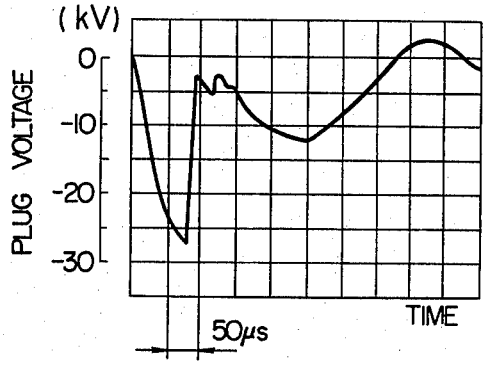
FIG. 2 is a diagram showing a voltage weveform produced between the plug electrodes upon ignition of the engine.
Figure 3:
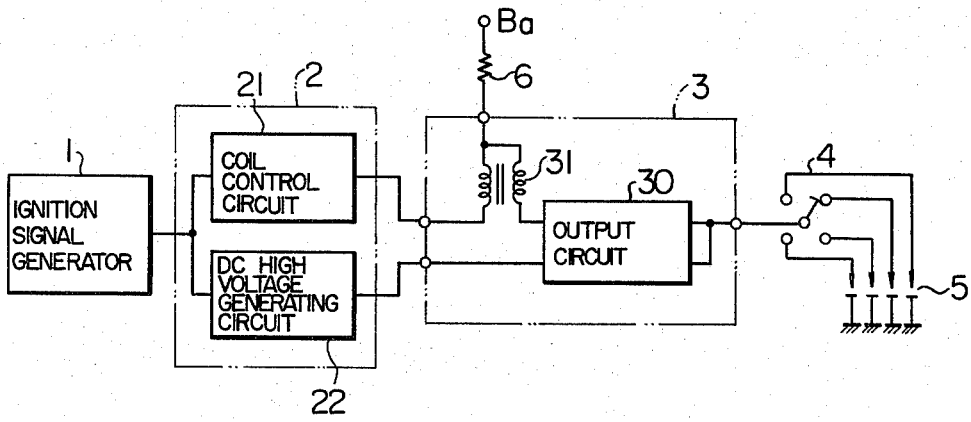
FIG. 3 is a block diagram showing schematically an ignition system according to the present invention.

FIG. 3 illustrates a block diagram of the ignition system according to embodiments of the invention. In the Figure, numeral 1 designates an ignition signal generating means mounted on a distributor shaft of an engine which is not shown so as to detect the energization starting time and the deenergization time of an ignition coil 31 and to generate a signal synchronized with the rotation of the engine. Numeral 2 designates an ignition control circuit comprising an ignition coil control circuit 21 for receiving the output signal of the ignition signal generating means 1 to control the primary winding of the ignition coil 31 and a DC high voltage generating circuit 22 for generating a DC high voltage, and 3 an ignition coil system responsive to the outputs of the ignition control circuit 2 to distribute a high voltage from the ignition coil 31 and the DC high voltage to the gaps of spark plugs 5 via a distributor 4. The ignition coil system 3 includes an output circuit 30 for delivering one or the other of the high voltage from the ignition coil 31 and the DC high voltage. Numeral 6 designates an external resistor having its one end connected to a vehicle battery Ba to limit the current in the ignition coil 31.

Figure 4:
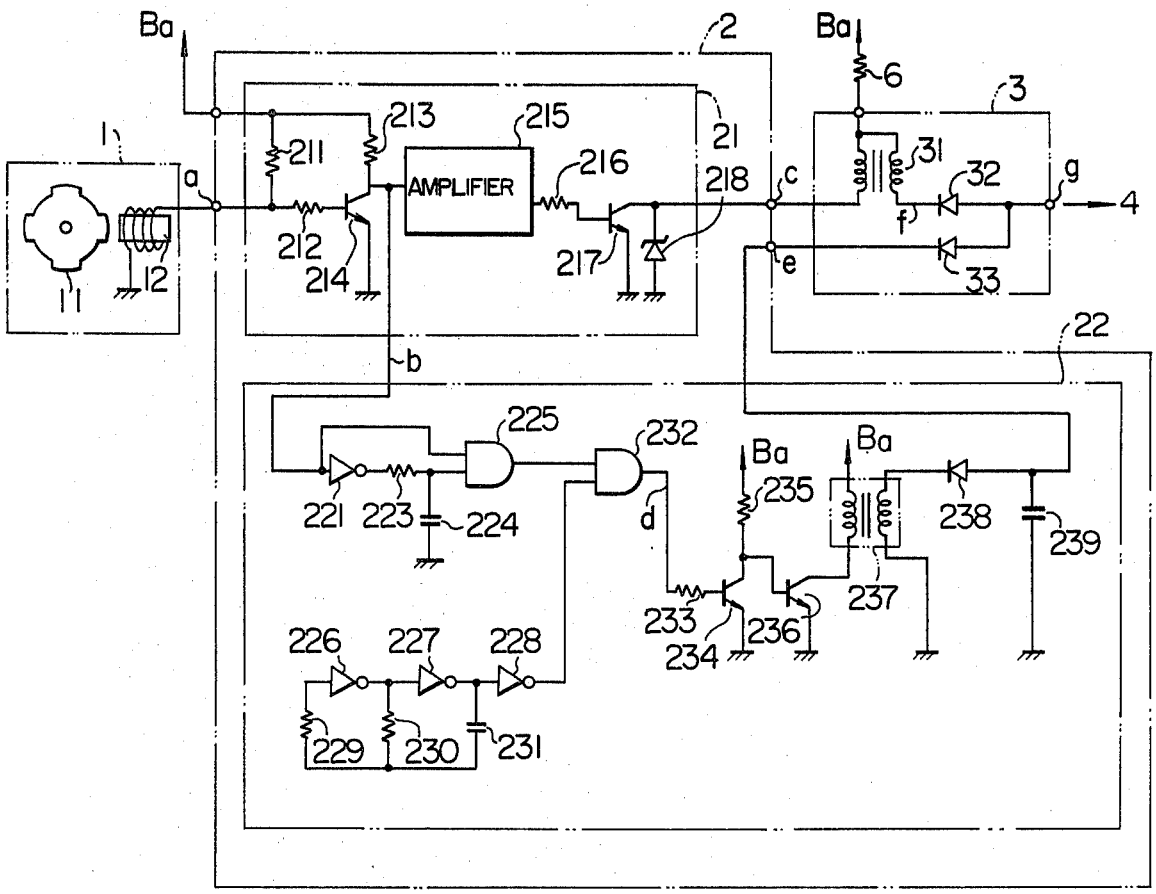
FIG. 4 is a detailed circuit diagram showing a first embodiment of the system according to the invention.

FIG. 4 is a circuit diagram showing an ignition system according to a first embodiment of the invention. Numeral 11 designates a rotor coupled to the distributor shaft which is not shown and including four projections in the case of a four-cylinder engine. Numeral 12 designates an electromagnetic pickup for detecting the position of the projections on the rotor 11. In the ignition control circuit 2, numeral 21 designates the known type of ignition coil control circuit responsive to the signal from the electromagnetic pickup 12 to energize and deenergize the ignition coil 31, and 22 the DC high voltage generating circuit. The ignition coil control circuit 21 comprises resistors 211, 212 and 213 and a transistor 214 for shaping the waveform of the signal from the electromagnetic pickup 12, a current ampligying amplifier 215, a resistor 216, a power transistor 217 and a Zener diode 218. The DC high voltage generating circuit 22 comprises a monostable circuit including a NOT circuit 221, a resistor 223, a capacitor 224 and an AND circuit 225, an oscillator cir circuit including NOT circuits 226, 227 and 228, resistors 229 and 230 and a capacitor 231, a transformer control circuit including an AND circuit 232, resistors 233 and 235 and transistors 234 and 236, a transformer 237, a diode 238 and a capacitor 239. The ignition coil system 3 comprises the ignition coil 31 of the known type and first and second high voltage diodes 32 and 33 constituting the output circuit 30.

Figure 6:
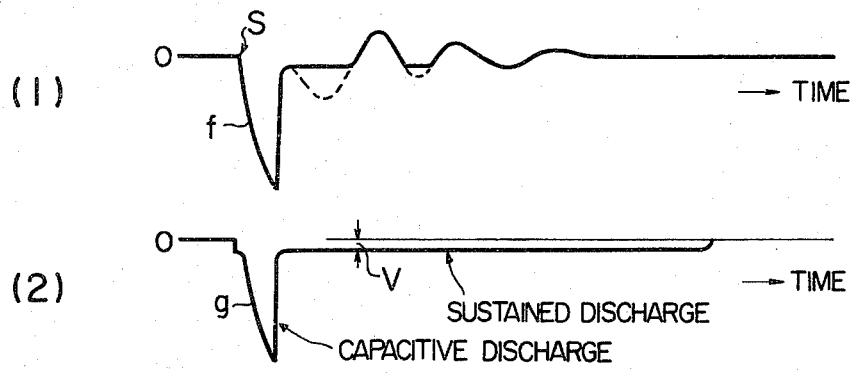
FIGS. 5 and 6 show a plurality of waveforms for explaining the operation of the system shown in FIG. 3.

Next, the operation of the first embodiment will be described in detail with reference to the time charts of the signal waveforms shown in FIGS. 5 and 6. The rotor 11 is rotated along with the distributor shaft and the electromagnetic pickup 12 generates a signal a of a waveform such as shown in (1) of FIG. 5. The signal a is shaped and the transistor 214 generates as its collector output an output signal b as shown in (2) of FIG. 5. The signal b is subjected to current amplification and inverted by the amplifier circuit 215 to drive the power transistor 217. The power transistor 217 is operated to generate an output c as shown in (3) of FIG. 5. Thus, when the signal b is at "0" level, a current flows to the base of the power transistor 217 so that the power transistor 217 is turned on and a current flows through the primary winding of the ignition coil 31 via the external resistor 6. When the signal b goes from "0" to "1" level, the power transistor 217 is turned off so that the primary current in the ignition coil 31 is interrupted and a negative high voltage is generated in the secondary winding of the ignition coil 31 at a time instant S as shown in (1) of FIG. 6. This high voltage is discharged at the spark plug 5 via the first diode 32. Also, the signal b is applied to the DC high voltage generating circuit 22 and consequently the monostable circuit (the NOT circuit 221, the AND circuit 225, the resistor 223 and the capacitor 224) generates at its output a pulse having a pulse width $\tau$ (e.g., 1 to 2 ms) from the leading edge of the signal b. On the other hand, the oscillator circuit (the NOT circuits 226, 227 and 228, the resistors 229 and 230 and the capacitor 231) generates pulses having a repetition rate of less than 1 ms and the AND circuit 232 passes the output pulse signal d of the oscillator circuit for the predetermined time $\tau$ from the leading edge of the signal b as shown in (4) of FIG. 5. This signal d operates both the transistors 234 and 236 so that a current following through the primary winding of the transformer 237 is controlled and a negative high voltage pulse is produced in the transformer secondary winding. The high voltage pulse is then recitified by the diode 238 and smoothed out by the capacitor 239, thus generating a negative high voltage e at an output terminal e as shown in (5) of FIG. 5. The absolute value of this negative high voltage e is preset to a value (e.g., about 2 KV) which is above the sustained discharge voltage (absolute value) and below the dielectric breakdown voltage (absolute value) at the spark plug 5. The transformer 237 is designed so that it has a current capacity which allows the sustained discharge to be effected satisfactorily.

The ignition coil system 3 will now be described. In FIG. 6 having in enlarged form the time axes corresponding to the discharge waveform portions, a symbol S designates a point corresponding to the leading edge of the output of the power transistor 217. The secondary generated voltage f of the ignition coil 31 is such that as shown in (1) of FIG. 6, the negative high voltage is produced in response to the deenergization of the primary winding of the ignition coil 31 and upon reaching the dielectric breakdown voltage the negative high voltage is discharged (capacitive discharge) at the spark plug 5 through the distributor 4 and decreased rapidly. The secondary generated voltage of the ignition coil 31 is applied to the high voltage diode 32, and the DC high voltage generated from the DC high voltage generating circuit 22 is applied to the high voltage diode 33. The high voltage diodes 32 and 33 select and deliver lower one of the applied voltages. As a result, the output voltage g of the ignition coil system 3 has a waveform such as shown in (6) of FIG. 5 and (2) of FIG. 6. In this case, as shown in (5) of FIG. 5, the DC high voltage from the DC high voltage generating circuit 22 is generated for the predetermined time period $\tau$ from the time S or the time prior to the secondary generated voltage of the ignition coil 31 reaching the dielectric breakdown voltage, and the DC high voltage is applied to the spark plug 5 via the second high voltage diode 33 for the predetermined time period $\tau$ from prior to the start of the capacitance discharge. Thus, in response to the voltage generated in the secondary winding of the ignition coil 31, dielectric breakdown occurs at the gap of the spark plug 5 causing capacitive discharge thereat and then a current flows from the plug gap to the DC high voltage generating circuit 22 via the second high voltage diode 33, thus effecting sustained discharge for a predetermined time which is determined by the DC high voltage generating circuit 22. Strictly, while the DC high voltage from the DC high voltage generating circuit 22 is generated for the predetermined period $\tau$ from the time of generation of the secondary voltage in the ignition coil 31, the time interval between the time of generation of the secondary voltage in the ignition coil 31 and the time at which the secondary voltage reaches the dielectric breakdown voltage causing capacitive discharge is very short and consequently the sustained discharge is substantially maintained for the predetermined period $\tau$ after occurrence of the capacitive discharge.

Figure 5:
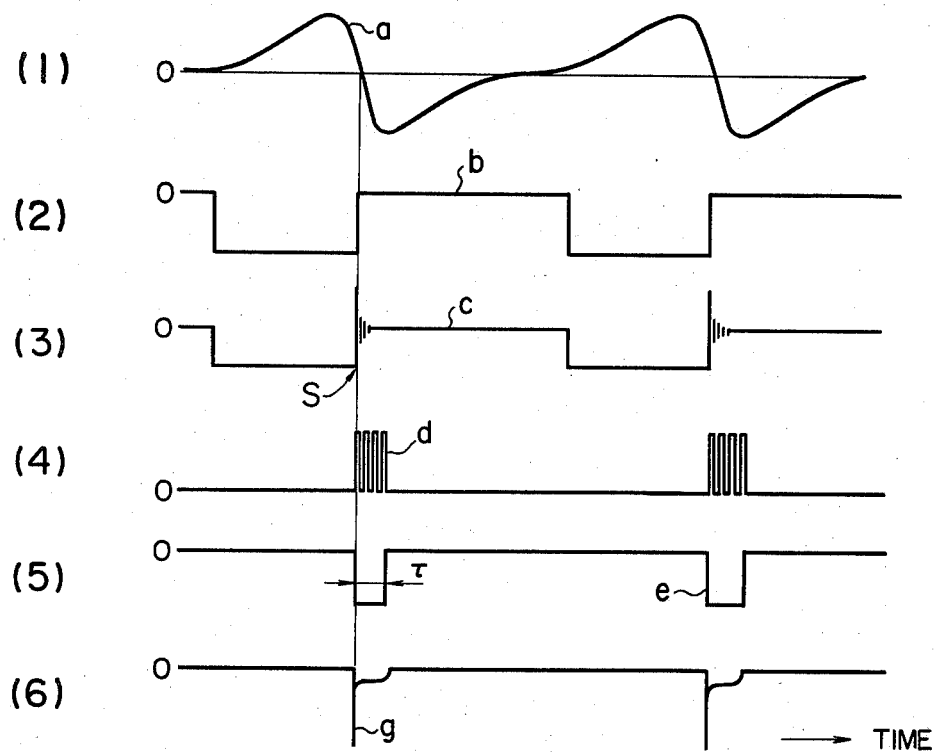
Figure 7:
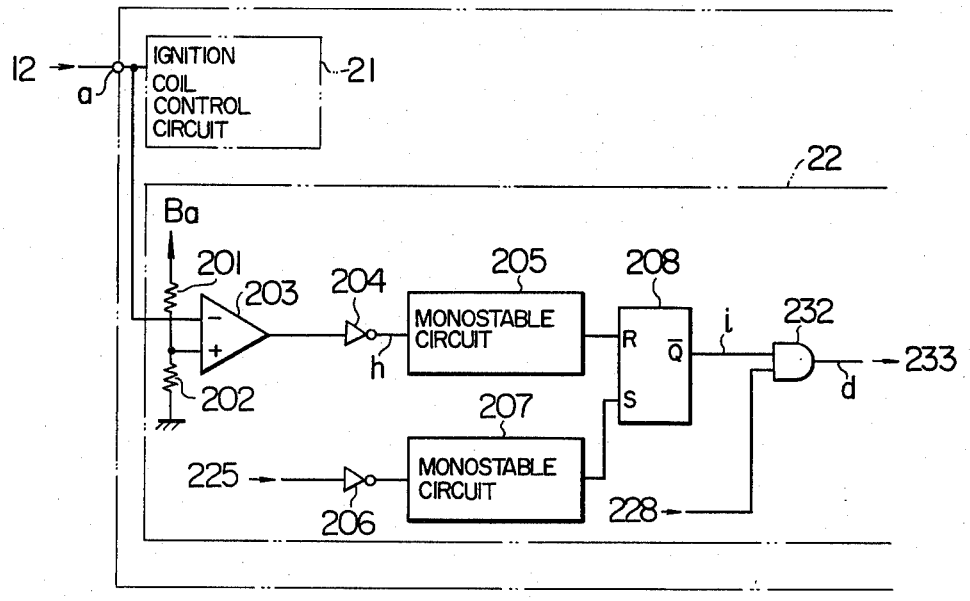
FIG. 7 is a circuit diagram showing the construction of a principal part of a second embodiment of the system according to the invention.
Figure 8:
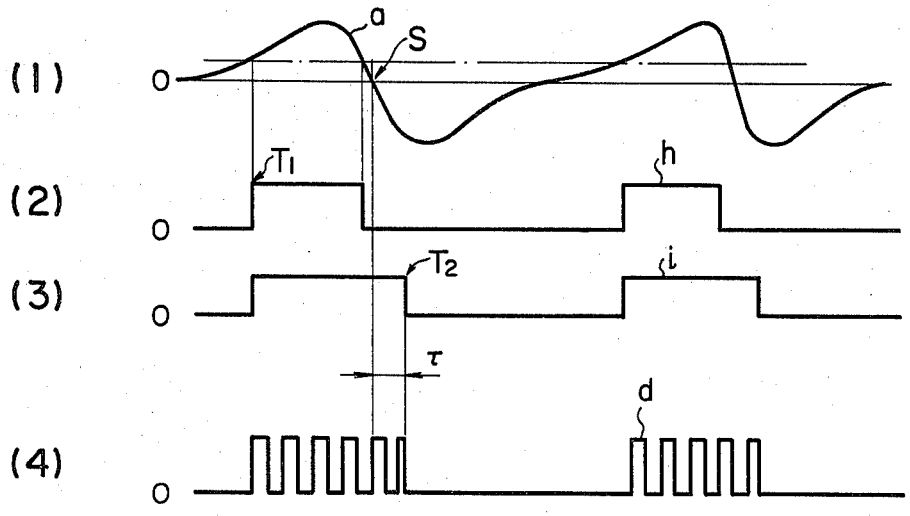

While, in the above-described first embodiment, the starting time of generation of the DC high voltage from the DC high voltage generating circuit 22 is selected to correspond to the leading edge of the signal b shown in (2) of FIG. 5 or the time of interrupting the current in the coil primary winding, it is possible to generate the DC high voltage at a time prior to the current interrupting time so as to decrease the oscillation frequency of the transformer 237. FIG. 7 shows the construction of a principal part of a second embodiment designed for this purpose, and FIG. 8 is a time chart showing the signal waveforms generated at various points in the second embodiment. In FIG. 7, the second embodiment differs from the first embodiment in that there are further provided a comparator circuit comprising resistors 201 and 202 and a comparator circuit 203, a NOT circuit 204, a monostable circuit 205, a NOT circuit 206, a monostable circuit 207 and a flip-flop circuit 208. The operation of the second embodiment is as follows. The output signal a of the electromagnetic pickup 12 having the waveform shown in (1) of FIG. 8 is applied to the comparator circuit which in turn compares it with a reference potential produced by dividing the battery voltage through the resistors 201 and 202 and shown by the one-dot chain line in (1) of FIG. 8. A pulse signal is generated from the comparator circuit as a result of the comparison, and the resulting pulse signal is inverted by the NOT circuit 204 to generate a signal h with a duration for a period of time during which the signal a is greater than the reference potential as shown in (2) of FIG. 8. The monostable circuit 205 generates a trigger pulse at a time $T_1$ corresponding to the leading edge of the signal h and the trigger pulse is applied to the reset imput of the flip-flop 208. On the other hand, the output of the AND circuit 225 or the pulse having the predetermined width is inverted by the NOT circuit 206 and applied to the monostable circuit 207, so that at the time of the leading edge of the applied signal or a time $T_2$ which is later than the time S of the signal a by the predetermined period $\tau$ the monostable circuit 207 generates and applies a trigger pulse to the set input of the flip-flop circuit 208. As a result, the flip-flop circuit 208 generates at its output Q an output circuit i which goes to "1" level during the time interval between the time $T_1$ and the time $T_2$ as shown in (3) of FIG. 8, and during the time interval the AND circuit 232 passes the pulse signal d from the NOT circuit 228 as shown in (4) of FIG. 8. Thus, the transformer 237 (FIG. 4) is operated and the DC high voltage is generated. In this way, as compared with the embodiment shown in FIG. 4, the time during which the transformer 237 is operated is increased and the oscillation period is increased, thus reducing the burden on the transformer 237.

Figure 9:
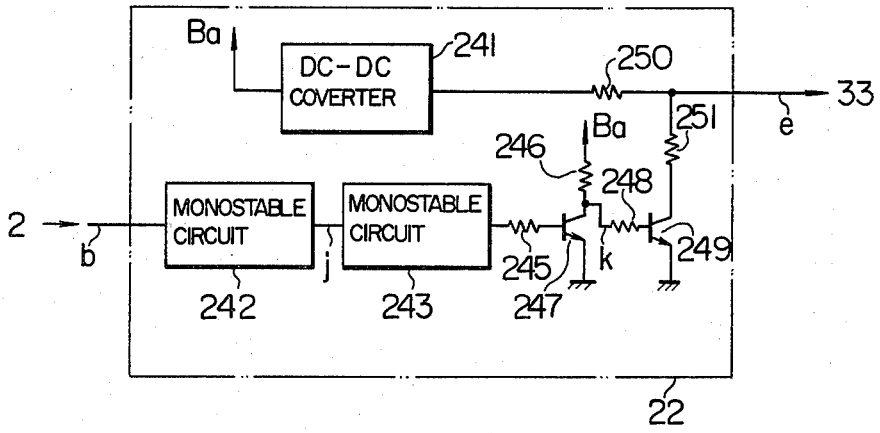
FIG. 9 is a circuit diagram showing the construction of a principal part of a third embodiment of the system according to the invention.
Figure 10:
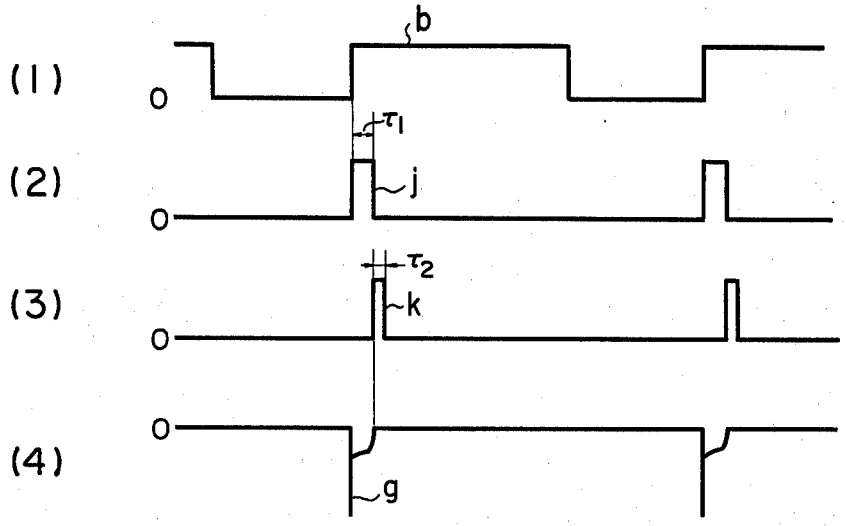
FIG. 10 shows a plurality of waveforms for explaining the operation of the system shown in FIG. 9.

Further, while, in the first embodiment, the DC high voltage generating circuit 22 employs the transformer 237 whose primary winding is controlled so as to maintain constant the generation of the DC high voltage and hence the sustained discharge time, it is possible to employ a high withstand voltage thyristor or transistor. FIG. 9 shows the construction of a principal part of a third embodiment using transistors, and FIG. 10 illustrates a time chart of the signal waveforms generated at various points in FIG. 9. The third embodiment shown in FIG. 9 differs from the first embodiment in that the DC high voltage generating circuit 22 comprises a DC—DC converter 241, monostable circuits 242 and 243, resistors 245, 246 and 248, a transistor 247, a high withstand voltage transistor 249 and high voltage resistors 250 and 251. The operation of the third embodiment will now be described with reference to the signal waveform time chart shown in FIG. 10. The monostable circuit 242 generates an output signal j shown in (2) of FIG. 10 and having a predetermined time width $\tau_1$ from the leading edge of the outpt signal b shown in (1) of FIG. 10 and produced by shaping the output of the electromagnetic pickup 12, and the monostable circuit 243 generates a pulse signal which goes to "0" level during a predetermined time width $\tau_2$ from the trailing edge of the signal j. This pulse signal turns on the transistor 247 and the collector output signal k of the transistor 247 becomes as shown in (3) of FIG. 10. On the other hand, the DC—DC converter 241 always receives the battery voltage and generates a negative DC high voltage. Thus when the primary winding of the ignition coil 31 is deenergized so that capacitive discharge occurs at the spark plug 5, the DC—DC converter 241 causes sustained discharge through the resistor 250. At the expiration of the period $\tau_1$ or so from the beginning of the discharge, the high voltage transistor 249 is turned on by the signal k and the potential of the output e of the DC high voltage generating circuit 22 becomes the divided potential by the resistors 250 and 251. In this case, if the output voltage of the DC—DC converter 241 is preset so as to be lower than the dielectric breakdown voltage of the plug gap but higher than the sustained discharge voltage under all the engine conditions and if the divided potential by the resistors 250 and 251 is preset so as to be lower than the sustained discharge voltage, the turning on of the high voltage transistor 249 makes the maintenance of the sustained discharge impossible and thus the sustained discharge is completed at the expiration of the period $\tau_1$ after the beginning of the discharge as shown in (4) of FIG. 10.

Figure 11:
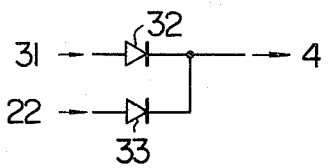
FIG. 11 is a circuit diagram showing a substitutory connection construction of high voltage diodes used in the system of this invention.

While, in the above-described embodiments, both the secondary high voltage of the ignition coil and the DC high voltage are in negative form, the similar effect can be obtained even if the voltages are in positive form. In the above-described embodiments, this can be accomplished by arranging so that each of the ignition coil 31 and the DC high voltage generating circuit 22 generates a positive output and by connecting the high voltage diodes 32 and 33 in the reverse directions as shown in FIG. 11 showing the fourth embodiment of this invention.

Further, while, in the above-described embodiments, the generating period of the DC high voltage from the DC high voltage generating circuit 22 is determined in terms of time, the same can be determined in terms of crank angle degrees.

Figure 12:
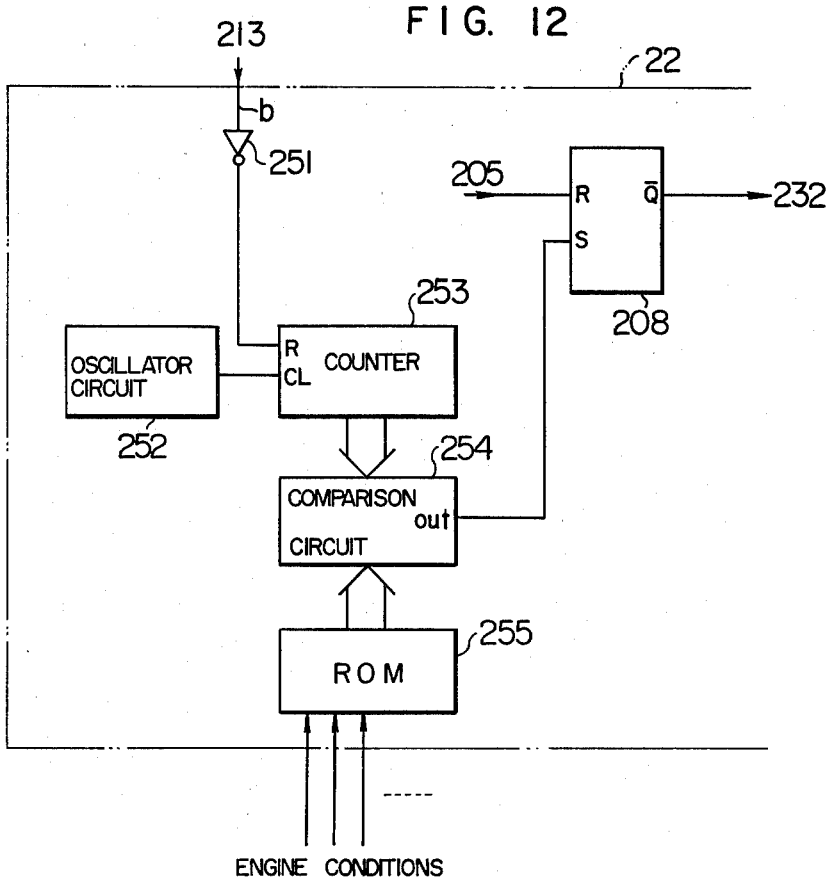
FIG. 12 is a circuit diagram showing the construction of a principal part of a fifth embodiment of the system according to the invention.

Still further, while, in these embodiments, the DC high voltage is generated from before the start of capacitive discharge up to a predetermined time or crank angle after the start of the capacitive discharge and the duration time of a sustained discharge after the start of the capacitive discharge is fixed, the generation period of the DC high voltage after the start of the capacitive discharge may be made variable so as to control and vary the DC high voltage generation period optimumly in accordance with the engine conditions. FIG. 12 shows the construction of a principal part of a fifth embodiment adapted for such variable control purposes. This fifth embodiment differs from the embodiment of FIG. 7 only in that the NOT circuit 206 and the monostable circuit 207 are eliminated and a NOT circuit 251, an oscillator circuit 252, a counter 253, a comparison circuit 254 and a memory device or ROM 255 are added. The engine condition (e.g., the rotational speed, load, water temperature or the like) is detected. The memory device 255 stores various preset periods corresponding to various engine conditions and generates one of the preset periods in response to the detection and applies it to the comparison circuit 254. On the other hand, the signal b shown in (2) of FIG. 5 is applied to the NOT circuit 251 and the inverted signal from the NOT circuit 251 is applied to the reset input of the counter 253 which in turn starts counting the output pulses of the oscillator circuit 253 from a time corresponding to the leading edge of the signal b or the time S in (3) of FIG. 5. The output pulses of the counter circuit 253 are applied to the comparison circuit 254 so that when the preset value generated from the memory device 255 is reached, the comparison circuit 254 generates an output pulse and applies it to the set input of the flip-flop circuit 208. In other words, a DC high voltage is applied from the time of the leading edge of the signal b or the time of generation of the secondary voltage in the ignition coil up to a time predetermined in accordance with the engine condition, thus making it possible to vary the duration of sustained discharge in accordance with the detected engine condition.

It will thus be seen from the foregoing description that in accordance with the present invention, by virtue of the fact that the ignition system includes the ignition coil system and the DC high voltage generating circuit whereby capacitive discharge is effected at the ignition point determined by an ignition coil designed to generate a high voltage and a DC high voltage preset so as to be lower than the dielectric breakdown voltage in absolute value magnitude but higher than the sustained discharge voltage in absolute value magnitude under all the engine operating conditions is applied to the plug gap from before the capacitive discharge up to a predetermined time or crank angle after the ignition thereby effecting sustained discharge by means of the DC high voltage, there are the following great advantages.

(1) Since, irrespective of the dielectric breakdown voltage value, the duration time of sustained discharge is maintained constant and the energy is supplied for a period of time sufficient to allow the flame core to grow up and effect the flame propagation by its own ability in the combustion chamber, the ignition performance is improved greately even in cases where the dielectric breakdown voltage is increased due to an increase in the compression ratio or the like.

(2) As compared with cases where the total energy of the ignition coil is increased so that the ignition performance is improved but wear of the plug electrodes is increased, the present invention ensures the supply of the optimum energy required for the ignition and there is a great advantage in view point of wear of the plug electrodes.

We claim:

1. An ignition system for an internal combustion engine having a plurality of spark plugs comprising:

an ignition coil including a primary coil and a secondary coil for generating a secondary voltage including a high voltage generated by interruption of a primary coil current, said secondary voltage reaching a dielectric breakdown voltage of a gap between discharge electrodes of any one of said spark plugs to cause a capacitive discharge therebetween;

a DC high voltage generating circuit for generating a DC high voltage which is, in absolute value magnitude, lower than the dielectric breakdown voltage and higher than a voltage required to sustain discharge between the discharge electrode gap during a predetermined time interval from before occurrence of the capacitive discharge to a predetermined time or a predetermined crank angle thereafter;

said DC high voltage generating circuit including memory means for storing a plurality of predetermined time periods corresponding to a plurality of engine conditions and for generating a signal indicative of one of said time periods in response to a detected engine condition, and a circuit responsive to said output signal of said memory means to determine said predetermined time interval after the beginning of the capacitive discharge, whereby the time of interrupting said DC high voltage is determined in dependence on the detected engine condition;

an output circuit for selectively applying one of the secondary voltage and the DC high voltage to the discharge electrode gap in accordance with relative levels of both voltages; and an ignition coil control circuit for controlling supply and interruption of the primary coil current.

2. An ignition system according to claim 1, in which said ignition coil is constructed to generate a negative secondary high voltage, and said DC high voltage generating circuit is constructed to generate a negative DC high voltage, wherein said output circuit includes a first high voltage diode having a cathode connected to a secondary output terminal of said ignition coil and an anode adapted to be connected to said spark plugs, and a second high voltage diode having a cathode connected to said DC high voltage generating circuit and an anode connected to the anode of said first high voltage diode.

3. An ignition system according to claim 1, in which said ignition coil is constructed to generate a positive secondary high voltage, and said DC high voltage generating circuit is constructed to generate a positive DC high voltage, wherein said output circuit includes a first high voltage diode having an anode connected to a secondary output terminal of said ignition coil and a cathode adapted to be connected to said spark plugs, and a second high voltage diode having an anode connected to said DC high voltage generating circuit and a cathode connected to the cathode of said first high voltage diode.

4. An ignition system according to claim 1, 2 or 3, wherein said DC high voltage generating circuit includes switching means for performing on-off operation at a predetermined period during said predetermined time interval, and a transformer having a primary winding connected to a battery and said switching means so that a primary current in said transformer is controlled by said switching means, whereby during said predetermined time interval a voltage of said battery is stepped up to generate said DC high voltage.

5. An ignition system according to claim 1, 2 or 3, wherein said DC high voltage generating circuit includes a circuit for generating said DC high voltage, high-voltage semiconductor switching means disposed to be turned on after the expiration of said predetermined time interval, and a circuit responsive to the turning on of said switching means to decrease said DC high voltage to a level less than said voltage required to maintain the sustained discharge.

6. An ignition system for an internal combustion engine comprising:

an ignition coil having a primary winding and a secondary winding for generating a secondary voltage including a high voltage generated by interruption of a primary current, said secondary voltage being decreased after occurrence of capacitive discharge at one of a plurality of spark plugs;

said plurality of spark plugs each being supplied with said secondary voltage of said ignition coil, at each of said spark plugs capacitive discharge is caused when said ignition coil secondary voltage reaches a dielectric breakdown voltage of a gap between electrodes of the spark plug and then sustained discharge is caused;

ignition signal generating means for generating an AC signal synchronized with the rotation of the engine;

control signal generating means responsive to said AC signal synchronized with the engine rotation to generate a control pulse signal having a first transition edge indicative of a time of starting flow of a primary current in said ignition coil and a second transition edge indicative of a time of interrupting the primary current flow;

control means responsive to said control pulse signal to control the primary current flow in said ignition coil;

a monostable circuit responsive to said control pulse signal to generate a pulse signal having a duration for a predetermined time interval from the second transition edge of the control pulse signal to a predetermined time or crank angle;

an oscillator circuit for generating repetitive pulses of a predetermined repetition rate;

an AND circuit having a first input terminal for receiving the output pulse signal of said monostable circuit and a second input terminal for receiving the repetitive pulses from said oscillator circuit for delivering the repetitive pulses during said predetermined time interval;

switching means responsive to the output pulse signal of said AND circuit to perform on-off operation during said predetermined time interval;

transformer means whose primary current is controlled in response to the operation of said switching means to thereby generate a high voltage pulse in its secondary winding during said predetermined time interval;

DC high voltage generating means for rectifying and smoothing said secondary high voltage pulse from said transformer means to generate during said predetermined time interval a DC high voltage which is lower than said dielectric breakdown voltage of spark plug gap in absolute value magnitude and which is higher than a voltage required to maintain said sustained discharge in absolute value magnitude; and output means connected to the secondary winding of said ignition coil and said DC high voltage generating means, whereby one of said secondary voltage generated by said ignition coil and said DC high voltage is selected in accordance with the relative levels thereof and supplied to the spark plug.

7. An ignition system for an internal combustion engine comprising:

an ignition coil having a primary winding and a secondary winding for generating a secondary voltage including a high voltage generated by interruption of a primary current, said secondary voltage being decreased after occurrence of capacitive discharge at one of a plurality of spark plugs;

said plurality of spark plugs each being supplied with said secondary voltage of said ignition coil, at each of said spark plugs capacitive discharge is caused when said ignition coil secondary voltage reaches a dielectric breakdown voltage of a gap between electrodes of the spark plug and then sustained discharge is caused;

ignition signal generating means for generating an AC signal synchronized with the rotation of the engine;

control signal generating means responsive to said AC signal synchronized with the engine rotation to generate a control pulse signal having a first transition edge indicative of a time of starting flow of a primary current in said ignition coil and a second transition edge indicative of a time of interrupting the primary current flow and corresponding to the point of positive to negative transition of said AC signal synchronized with the engine rotation;

control means responsive to said control pulse signal to control the primary current flow in said ignition coil;

comparison means connected to said ignition signal generating means for comparing said AC signal synchronized with the engine rotation and a positive reference voltage so as to generate a pulse signal for a period of time during which said AC signal is greater than said reference voltage;

first trigger pulse generating means responsive to the leading edge of said output pulse signal of said comparison means to generate a first trigger pulse;

monostable circuit means responsive to said control pulse signal to generate a pulse signal for a predetermined period from the second transition edge of said control pulse signal;

second trigger pulse generating means responsive to the trailing edge of said output pulse signal of said monostable circuit means to generate a second trigger pulse;

a flip-flop circuit responsive to said first and second trigger pulses to generate a pulse signal having a duration for a time interval from the time of generation of said first trigger pulse to the time of generation of said second trigger pulse;

an oscillator for generating repetitive pulses having a predetermined repetition rate;

an AND circuit having a first input terminal for receiving said output pulse signal of said flip-flop circuit and a second input terminal for receiving said repetitive pulses from said oscillator for delivering the repetitive pulses during said time interval;

switching means responsive to the output pulse signal of said AND circuit to perform on-off operations during said time interval;

transformer means whose primary current is controlled in response to the operation of said switching means, to thereby generate a high voltage pulse in its secondary winding during said time interval;

DC high voltage generating means for rectifying and smoothing said secondary high voltage pulse from said transformer means to generate during said time interval a DC high voltage which is lower than said dielectric breakdown voltage of spark plug gap in absolute value magnitude and which is higher than a voltage required to maintain said sustained discharge in absolute value magnitude; and output means connected to the secondary winding of said ignition coil and said DC high voltage generating means, whereby one of said secondary voltage generated by said ignition coil and said DC high voltage is selected in accordance with the relative levels thereof and supplied to the spark plug.

8. An ignition system for an internal combustion engine comprising:

an ignition coil having a primary winding and a secondary winding for generating a secondary voltage including a high voltage generated by interruption of a primary current, said secondary voltage being decreased after occurrence of capacitive discharge at one of a plurality of spark plugs;

said spark plugs each being supplied with said secondary voltage of said ignition coil, at each of said spark plugs capacitive discharge is caused when said ignition coil secondary voltage reaches a dielectric breakdown voltage of a gap between electrodes of the spark plug and then sustained discharge is caused;

ignition signal generating means for generating an AC signal synchronized with the rotation of the engine;

control signal generating means responsive to said AC signal synchronized with the engine rotation to generate a control pulse signal having a first transition edge indicative of a time of starting flow of a primary current in said ignition coil and a second transition edge indicative of a time of interrupting the primary current flow;

control means responsive to said control pulse signal to control the primary current flow in said ignition coil;

a first monostable circuit responsive to said control pulse signal to generate a pulse signal having a duration for a predetermined time interval from the second transition edge of the control pulse signal to a predetermined time or crank angle;

a second monostable circuit connected to said first monostable circuit to generate a pulse signal having a duration from the trailing edge of the output pulse signal of said first monostable circuit to a determined time;

switching means responsive to the output pulse signal of said second monostable circuit so as to be turned on;

DC high voltage generating means for generating a DC high voltage which is lower than said dielectric breakdown voltage of spark plug gap in absolute value magnitude and which is higher than a voltage required to maintain said sustained discharge in absolute value magnitude;

DC high voltage output means connected to an output of said DC high voltage generating means and said switching means, whereby said DC high voltage is delivered when said switching means is off and a DC voltage lower than said voltage required to maintain said sustained discharge is generated when said switching means is on; and output means connected to the secondary winding of said ignition coil and said DC high voltage output means, whereby one of said secondary voltage generated by said ignition coil and said DC output voltage of said DC high voltage output means is selected in accordance with the relative levels thereof and supplied to the spark plug.

9. An ignition system for an internal combustion engine comprising:

an ignition coil having a primary winding and a secondary winding for generating a secondary voltage including a high voltage generated by interruption of a primary current, said secondary voltage being decreased after occurrence of a capacitive discharge at one of a plurality of spark plugs;

said plurality of spark plugs each being supplied with said secondary voltage of said ignition coil, at each of said spark plugs capacitive discharge is caused when said secondary voltage reaches a dielectric breakdown voltage of a gap between electrodes of the spark plug and then sustained discharge is caused;

ignition signal generating means for generating an AC signal synchronized with the rotation of the engine;

control signal generating means responsive to said AC signal synchronized with the engine rotation to generate a control pulse signal having a first transition edge indicative of a time of starting flow of primary current in said ignition coil and a second transition edge indicative of a time of interrupting the primary current flow and corresponding to the point of positive to negative transition of said AC signal synchronized with the engine rotation;

control means responsive to said control pulse signal to control the primary current flow in said ignition coil;

comparison means connected to said ignition signal generating means for comparing said AC signal synchronized with the engine rotation and a positive reference voltage to generate a pulse signal for a period of time during which said AC signal is greater than said reference voltage;

trigger pulse generating means responsive to the leading edge of said output pulse signal of said comparison means to generate a first trigger pulse;

an oscillator for generating repetitive pulses having a predetermined repetition rate;

a counter responsive to the second transition edge of said control pulse signal to start counting said repetitive pulses of said oscillator;

memory means for storing a plurality of predetermined time periods or crank angles each corresponding to one of a plurality of engine conditions and for producing in accordance with a detected engine condition, a signal indicative of the corresponding one of said predetermined time periods or crank angles;

a comparison circuit connected to said counter and said memory means to generate an output pulse as a second trigger pulse when the output of said counter coincides with the output of said memory means;

a flip-flop circuit responsive to said first and second trigger pulses to generate a pulse signal having a duration for a time interval from the time of generation of said first trigger pulse to the time of generation of said second trigger pulse;

an oscillator circuit for generating repetitive pulses of a predetermined repetition rate;

an AND circuit having a first input terminal for receiving said output pulse signal of said flip-flop circuit and a second input terminal for receiving said repetitive pulses from said oscillator circuit to deliver said repetitive pulses signal during said time interval;

switching means responsive to the output pulse signal of said AND circuit to perform on-off operations during said time interval;

transformer means whose primary current is controlled in response to the operation of said switching means, to thereby generate a high voltage pulse in its secondary winding during said time interval;

DC high voltage generating means for rectifying and smoothing said secondary high voltage pulse from said transformer means to generate during said time interval a DC high voltage which is lower than said dielectric breakdown voltage of spark plug gap in absolute value magnitude and which is higher than a voltage required to maintain said sustained discharge in absolute value magnitude; and output means connected to the secondary winding of said ignition coil and said DC high voltage generating means, whereby one of said secondary voltage generated by said ignition coil and said DC high voltage is selected in accordance with the relative levels thereof and supplied to the spark plug.

* * * * *